US006933018B2

(12) United States Patent
Masuko

(10) Patent No.: US 6,933,018 B2
(45) Date of Patent: Aug. 23, 2005

(54) PROCESSES FOR PRODUCING A WHETSTONE AND WHETSTONE PELLETS WITH UNIFORM ABRASION LAYERS

(75) Inventor: Masami Masuko, Yokohama (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 10/618,706

(22) Filed: Jul. 15, 2003

(65) Prior Publication Data

US 2004/0058062 A1 Mar. 25, 2004

Related U.S. Application Data

(63) Continuation of application No. PCT/JP02/00180, filed on Jan. 15, 2002.

(30) Foreign Application Priority Data

Jan. 16, 2001 (JP) ..... 2001-7794
Jul. 2, 2001 (JP) ..... 2001-200383

(51) Int. Cl.[7] ..... B05D 1/36
(52) U.S. Cl. ..... 427/402; 427/443.2; 427/282
(58) Field of Search ..... 427/402, 430.1, 427/443.2, 282, 180, 201

(56) References Cited

U.S. PATENT DOCUMENTS 4,536,195 A * 8/1985 Ishikawa ..... 51/293
5,660,320 A * 8/1997 Hoffmuller et al. ..... 228/122.1
5,919,084 A * 7/1999 Powell et al. ..... 451/344
6,042,886 A * 3/2000 Matthee et al. ..... 427/249.11
6,106,382 A 8/2000 Sakaguchi
6,428,407 B1 * 8/2002 Elder ..... 451/530
6,726,531 B1 * 4/2004 Harrel ..... 451/28

FOREIGN PATENT DOCUMENTS

| | | | |
|---|---|---|---|
| JP | 2-282362 | | 11/1990 |
| JP | 3-44559 | * | 4/1991 |
| JP | 04-223875 | * | 8/1992 |
| JP | 09-254040 | | 9/1997 |
| JP | 10-006224 | | 1/1998 |
| JP | 11-198047 | | 7/1999 |
| JP | 11-198052 | | 7/1999 |
| JP | 2000-084820 | | 3/2000 |
| JP | 2000-117605 | | 4/2000 |
| JP | 2001-260031 | | 9/2001 |
| WO | WO-02/055264 | | 7/2002 |

* cited by examiner

*Primary Examiner*—Bret Chen
(74) *Attorney, Agent, or Firm*—Morgan, Lewis & Bockius LLP

(57) ABSTRACT

A process for producing a whetstone, wherein a whetstone pellet is composed of at least one columnar base body fixed on a pedestal, and an abrasive grain part, formed on an end surface of the base body, containing numerous abrasive grains formed by electroless plating The abrasive grain part, is a plated layer formed on the end surface of the base body by stirring a plating solution containing abrasive grains, such that the distribution of the abrasive grains in the abrasive grain part is uniformly distributed.

9 Claims, 9 Drawing Sheets

PROCESSES FOR PRODUCING A WHETSTONE AND WHETSTONE PELLETS WITH UNIFORM ABRASION LAYERS

This application is a continuation of PCT/JP02/00180 filed Jan. 15, 2002.

TECHNICAL FIELD

The present invention relates to a whetstone pellet used for grinding or polishing glass and metal, a plurality of which is fixed on a pedestal, a whetstone, processes for producing them, a process for producing an optical element using the whetstone, and a process for producing an exposure apparatus.

BACKGROUND ART

The whetstone pellets are fixed on a pedestal with an adhesive to be used as a whetstone. The whetstone pellet contains abrasive grains bound with a binder, such as a metallic bond, a resin bond or a vitrified bond.

However, in the conventional technique, for example, even when it is intended to obtain whetstone pellets having fine abrasive grains mixed therein for carrying out higher precision processing, the abrasive grains are not uniformly mixed, and as a result, such a problem arises in that no product available for practical use can be obtained.

DISCLOSURE OF THE INVENTION

The present invention has been made in view of the conventional problems, and an object thereof is to provide a whetstone pellet in which distribution of abrasive grains can be uniformized, a whetstone, processes for producing them, a process for producing an optical element using the whetstone, and a process for producing an exposure apparatus.

A whetstone pellet, for attaining the object, a plurality of which is fixed on a pedestal to form a whetstone, comprising a columnar base body to be fixed to the pedestal, and a plated layer formed on a surface of the base body, containing abrasive grains.

The plated layer may be either an electrolytic plated layer or an electroless plated layer. From the view point of production process and the like, the electroless plated layer is preferred. In the case where the plated layer is formed by electroless plating, the base body is preferably made of a metal that functions as a catalyst upon forming the electroless plated layer.

A process for producing a whetstone pellet, for attaining the object, a plurality of which is fixed on a pedestal to form a whetstone, comprising steps of:

preparing plural columnar base bodies to be fixed on said pedestal, and forming an abrasive grain layer with a plating solution containing abrasive grains on end surfaces of the columnar base bodies, which are opposite to the end surface to be fixed to said pedestal.

In the case where an electrolytic plating solution is used as the plating solution in the process for producing a whetstone pellet, it is preferred that the base body is made of an electroconductive material, the plural base bodies are electrically connected to each other with an electroconductive material, and the plural base bodies electrically connected are immersed in an electrolytic plating solution containing abrasive grains to form the abrasive grain layer on the end surfaces of the plural base bodies. In the case where the abrasive grain layer is formed by electrolytic plating in this manner, it is preferred that the abrasive grain layer is processed to uniformize the thickness of the abrasive grain layer. In the case where an electroless plating solution is used as the plating solution in the process for producing a whetstone pellet, it is preferred that the plural base bodies are fixed on a fixing plate having been prepared, a catalyst layer for electroless plating is formed on an end surface of the base body opposite to the end surface to be fixed to the fixing plate before or after fixing the plural base bodies on the fixing plate, and the plural base bodies fixed on the fixing plate are immersed in an electroless plating solution to form the abrasive grain layer on the catalyst layers of the plural base bodies. The abrasive grain layer formed with an electroless plating solution is almost amorphous.

A whetstone, for attaining the object, which has plural abrasive grain layers scattered on a pedestal, comprising:

plural columnar base bodies fixed to said pedestal, and plated layers that function as said abrasive grain layers, containing abrasive grains, and formed only on surfaces of said base bodies including end surfaces of said base bodies.

Another whetstone, for attaining the object, has plural abrasive grain layers dotting a pedestal, having:

plural columnar base bodies fixed to the pedestal, plated layers that function as the abrasive grain layers, which contain abrasive grains formed on end surfaces of the base bodies, and a masking layer arranged among the plural base bodies to fix the plural base bodies on the pedestal and to function as a masking agent upon forming the plated layers.

Here, the plated layers of the whetstones are preferably amorphous plated layers formed by electroless plating, as similar to the whetstone pellet described above.

A process for producing a whetstone, for attaining the object, which has plural abrasive grain layers dotting a pedestal, comprises steps of:

preparing the pedestal and plural columnar base bodies to be fixed on the pedestal, fixing the plural base bodies on the pedestal, forming catalyst layers for electroless plating on end surfaces of the base bodies, and forming the abrasive grain layers on the catalyst layers using electroless plating solution containing abrasive grains. It is preferred upon fixing the plural base bodies on the pedestal that an adhesive is applied on the whole surface of the pedestal, and the plural base bodies are placed on the adhesive to fix the plural base bodies on the pedestal. In this case, the adhesive also functions as a masking agent against electroless plating. In the above-described process for producing a whetstone, a plane shape formed by continuation of the end surfaces of the plural base bodies may be processed to have an inverse shape of a surface to be processed after fixing the plural base bodies on the pedestal but before plating the respective end surfaces of the base bodies.

Another process for producing a whetstone, for attaining the object, which has plural abrasive grain layers scattered on a pedestal, comprises steps of:

preparing the pedestal having electroconductivity at least on a surface, on which the abrasive grain layers are to be formed, and plural columnar base bodies having electroconductivity, which are to be fixed on the pedestal, fixing the plural base bodies on the surface of the pedestal, on which the abrasive grain layers are to be formed, in such a manner capable of electrically connecting to each other through the pedestal, and immersing the plural base bodies fixed on the pedestal in an electrolytic plating solution containing abrasive grains to form the abrasive grain layers on end surfaces of the base bodies using electrolytic plating solution containing the abrasive grains. It is preferred upon fixing the plural base bodies on the pedestal that a non-electroconductive adhesive is applied to intervals among the plural base bodies on the pedestal, to permit the adhesive to function as a masking agent against the electrolytic plating. In the case where the abrasive grain layers are formed by electrolytic plating in this manner, it is preferred that after forming the abrasive grain layers, a plane shape formed by continuation of surfaces of the plural abrasive grain layers are processed, to have an inverse shape of an objective surface to be processed.

A process for producing an optical element provided by the invention is characterized by comprising steps of:

preparing a whetstone in which plural base bodies are fixed on a pedestal, and plated layers containing numerous abrasive grains are formed only on surfaces of the base bodies including end surfaces of the base bodies, and processing a raw material of an optical element by using the whetstone to form the optical element or an intermediate product of the optical element.

A process for producing an optical exposure apparatus equipped with an optical system including a lens, provided by the invention, comprises steps of:

preparing a whetstone in which plural base bodies are fixed on a pedestal, and plated layers containing abrasive grains are provided only on surfaces of the base bodies including end surfaces of the base bodies, processing a raw material of a lens by using the whetstone to form the lens or an intermediate product of the lens, and installing the lens obtained by processing the raw material of a lens into the optical system.

As described above, according to the whetstone pellet and the whetstone of the invention, the abrasive grain part is made of the plating layer containing the abrasive grains formed by mixing the abrasive grains in the plating solution in a liquid form, whereby the abrasive grains can be uniformly dispersed. Therefore, the whetstone of the invention is suitably used for superfine processing which requires abrasive grains of a small particle diameter. Further, since the plating layer serves as a binder of the abrasive grains, shape retentiveness of the abrasive grains increases and the binder itself is hard in nature, and therefore the whetstone lifetime can be prolonged.

In the case where the abrasive grain part is an amorphous plated layer formed by using electroless plating solution containing abrasive grains, the thickness of the abrasive grain part can be uniformized since the thickness of the plated layer on the outer periphery does not increase as differing in electrolytic plating.

Furthermore, in the whetstone pellet of the invention, a whetstone having a large size to a certain degree can be obtained since the abrasive grain part is formed on the base body, therefore the handling quality upon fixing the whetstone pellet on the pedestal can be improved. Moreover, in order to obtain a whetstone pellet having a prescribed height, the plating time can be reduced in comparison with the case of producing a whetstone pellet of a solid plated layer.

BRIEF DESCRIPTION OF DRAWINGS

FIG. 2A is an explanatory view showing fixing process of a base body.

FIG. 2B is an explanatory view showing forming process of a catalyst layer.

FIG. 2C is an explanatory view showing forming process of an electroless plated layer, FIG. 2D is an explanatory view of a finished whetstone separated from a fixing plate.

FIG. 3A is an explanatory view showing fixing process of a base body to a pedestal.

FIG. 3B is an explanatory view showing working process of the end surface of the base body.

FIG. 3C is an explanatory view showing forming process of an electroless plated layer.

FIG. 3D is an explanatory view of a finished whetstone.

FIG. 4A is an explanatory view showing fixing process of a base body to a pedestal.

FIG. 4B is an explanatory view showing working process of the end surface of the base body.

FIG. 4C is an explanatory view showing condition of the end surface of the base body after finishing working process.

FIG. 5A is an explanatory view of material of the optical element.

FIG. 5B is an explanatory view showing shape creating process.

FIG. 5C is an explanatory view showing rough grinding process.

FIG. 5D is an explanatory view showing fine grinding process.

FIG. 5E is an explanatory view of a finished optical element.

FIG. 6A is an explanatory view showing surface conditions, when a fluorite is grinded in a manner that the 111 plane thereof is perpendicular to the scheduled optical axis.

FIG. 6B is an explanatory view showing surface conditions, when a fluorite is grinded in a manner that the 110 plane thereof is perpendicular to the scheduled optical axis.

FIG. 6C is an explanatory view showing surface conditions, when a fluorite is grinded in a manner that the 112 plane thereof is perpendicular to the scheduled optical axis.

FIG. 7A is an explanatory view showing fixing process of a base body to a pedestal.

FIG. 7B is an explanatory view showing working process of the end surface of the base body.

FIG. 7C is an explanatory view showing process before plating.

FIG. 8D is an explanatory view showing forming process of an electrolytic plated layer.

FIG. 8E is an explanatory view of a finished whetstone.

BEST MODE FOR CARRYING OUT THE INVENTION

Various kinds of embodiments according to the invention will be described below with reference to the drawings.

First Embodiment

A whetstone pellet as a first embodiment according to the invention will be described with reference to FIGS. 1 and 2.

Figure 1:
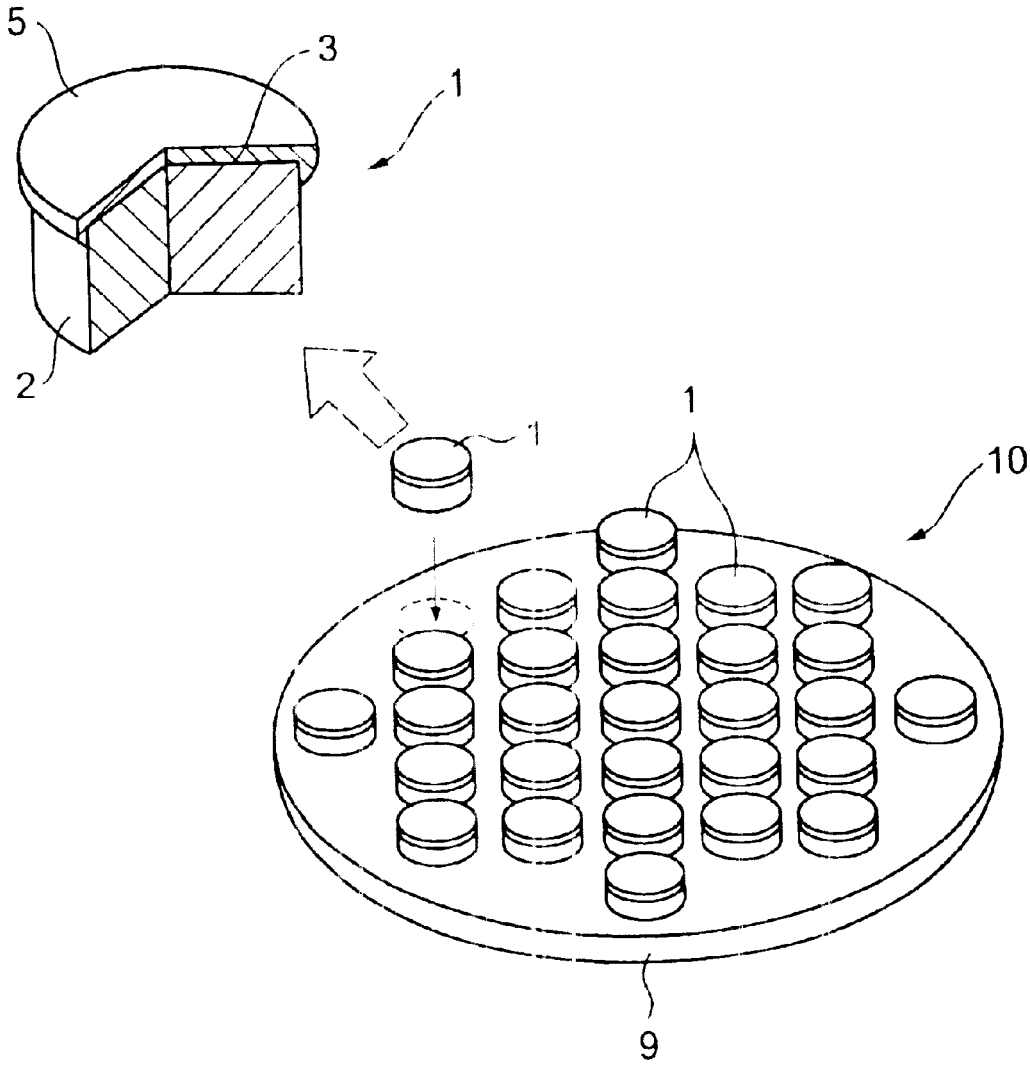
FIG. 1 is a perspective view of a whetstone and a whetstone pellet of one embodiment of the present invention.

As shown in FIG. 1, a plurality of whetstone pellets 1 of this embodiment is fixed on a pedestal 9, which is used as a whetstone 10. The whetstone 10 has a columnar base body 2 and an abrasive grain part 5 formed on one end surface 3 of the base body 2. The abrasive grain part 5 is formed as an amorphous plated layer containing abrasive grains by an electroless plating method.

In order to obtain the whetstone pellet 1, the dimensions of the base body 2 is firstly determined depending upon the required dimensions, such as the outer diameter, the height and the like, of the whetstone pellet 1. The material of the base body 2 is preferably such a material that is not easily corroded by an electroless plating solution and provides good adhesiveness to the electroless plating layer formed on the surface of the base body 2. Furthermore, the material of the base body 2 is preferably one capable of maintaining good adhesiveness with an adhesive which is used to attach the base body 2 to the pedestal 9 of the whetstone 1, and is most preferably a metal in order to retain mechanical rigidity. Among metals, metals are suited which have a catalytic function accelerating plating reaction or metals capable of easily forming a catalyst on the surface of the base body 2 before plating. The former includes iron and nickel, and the latter includes stainless steel, aluminum and brass. In particular, stainless steel and aluminum are preferred since the remaining abrasive grain part can be easily removed upon reuse of the base body 2.

Because the plane shape of the base body 2 is strictly reproduced in electroless plating, it is preferred that the surface of the base body 2 is smoothly finished in advance. In the practical case where the abrasive grain part 5 is formed by electroless plating, it is preferred to use a fixing plate capable of fixing plural base bodies 2, 2, . . . for producing plural whetstone pellets 1, 1, . . . at the same time. The dimension of the fixing plate is determined depending upon the number of the whetstone pellets 1 to be produced. Such a material should be selected as the fixing plate for repeated use that is not easily corroded with a pre-treating solution of electroless plating and with the electroless plating solution and is not dissolved with a masking agent described later. In the case where a masking step described later is simplified, the fixing plate made of a resin is suited. In the case where a large number of base bodies are fixed on the fixing plate, the fixing plate has to withstand the weight of the base bodies, and in order to maintain mechanical rigidity, a metal, particularly stainless steel, is preferred, and as a resin, PTFE (polytetrafluoroethylene) is also preferred.

The plural base bodies 2, 2, . . . are fixed on the fixing plate with an adhesive, and the region on the surface of the base body where no plating is applied, i.e., the region where no abrasive grain part 5 is formed, is masked. Before fixing of the base bodies 2, the fixing plate and the base bodies 2 are degreased with a solvent. As an adhesive for fixing the base bodies 2 to the fixing plate, such one is preferred that can retain the base bodies 2 during the steps from the pre-treatment of electroless plating to the electroless plating and has a masking function, but easily releases the base bodies 2 from the fixing plate after the electroless plating. In other words, such an adhesive is used for both purposes of fixation and masking of the base bodies 2. However, the adhesive used for fixing of the base bodies 2 and the masking agent used for masking the base bodies 2 are not always the same material, and they may be different materials. However, it is preferred that they are the same material from the standpoint of simplification of the process.

In the case where the fixing plate is made of a metal, the plating is also deposited on the fixing plate itself, and thus, the entire exposed metallic parts immersed in the plating solution are necessarily masked, but in the case where the fixing plate is made of a resin, no masking of the fixing plate is necessary. Even in the case where the thickness of the masking film is nonuniform, no problem arises since an electroless plated layer deposited on the base body has a uniform thickness owing to the characteristics thereof.

After masking, a catalyst layer for electroless plating is formed on a region on the surface of the base bodies 2 where no masking film is formed. In the case where the base body itself has catalytic nature, prescribed alkali degreasing and activation treatment are carried out to remove an oxide layer and the like on the surface of the region on the base body where no masking film is formed, so as to use the region as the catalyst layer. On the other hand, in the case where the base body itself has no catalytic nature, prescribed alkali degreasing and activation treatment are carried out, and then a catalyst layer is formed on the surface of the base body. The formation of the catalyst layer is carried out, for example, in such a manner in the case where the material of the base body 2 is brass or stainless steel that the base body 2 is immersed in an aqueous solution containing palladium chloride as a major component to deposit a layer of palladium to be a catalyst on the surface of the base body. In the case where the material of the base body 2 is aluminum, the base body 2 is immersed in a zincate conversion solution to deposit a layer of zinc to be a catalyst on the surface of the base body. The catalyst accelerating reaction of electroless plating include from metallic elements of Group 8, such as iron, ruthenium and the like to metallic elements of Group 10, such as nickel, palladium and the like. While the catalyst layer is formed on the base body after fixing the base body on the fixing plate herein, it is possible that the base body is fixed on the fixing plate, after forming the catalyst layer on the base body.

The formation of the abrasive grain part 5 is carried out by using an electroless plating solution having good uniform deposition property as an advantage. As the electroless plating solution, for example, a nickel-phosphorous plating solution is used. Abrasive grains are mixed in the electroless plating solution. Commercially available diamond powder, cubic boron nitride (CBN) and the like may be used as the abrasive grains without limitation in particle diameter, and those of from approximately 0.1 to 200 $\mu$m serve wide ranges of purposes. After putting the abrasive grains in the plating solution, the base body 2 having the catalyst layer formed thereon is put in the electroless plating solution under such conditions that the plating solution is stirred with a stirrer or the like to effect uniform dispersion of the abrasive grains, whereby a plated layer containing abrasive grains, having a uniform thickness is formed on the region having the catalyst layer to constitute an electroless plated layer, i.e., the abrasive grain part 5 using an amorphous plated layer as a binder. The thickness of the abrasive grain part 5 may be controlled mainly by the temperature of the plating solution and the plating time.

After completion of the electroless plating treatment, the base bodies are detached from the fixing plate, and the masking film is removed to obtain the whetstone pellets 1.

In the case where an electrolytic plating method is used instead of the electroless plating method as described above, an electrolytic plated layer is deposited as concentrated to convex parts, so as to fail to allow the layer to have a uniform thickness. In the electroless plating method in this embodiment, on the other hand, it is possible to allow the layer thickness to be uniform without concentrated deposition of the plated layer on convex parts and peripheral parts owing to the nature of electroless plating.

In this embodiment, the abrasive grains are uniformly dispersed in the plated layer thus deposited to be the abrasive grain part 5 because the abrasive grains are mixed in the plating solution which is a liquid form, and the plating solution containing the abrasive grains mixed therein is stirred during the deposition of the plated layer. Accordingly, for example, in the case where a whetstone containing abrasive grains having a extremely small particle diameter is required to finish machining, it is significantly effective since the distribution of the abrasive grains is uniformized even though the diameter of the abrasive grains is small.

Furthermore, the amorphous plated layer formed by the electroless plating method functions as material for binding the abrasive grains, and thus high retentivity of the abrasive grains can be obtained to prolong the service life of the whetstone. Since the amorphous plated layer as a binder material is basically hard, it suffers less surface denaturation of the abrasive grain layer upon grinding and polishing, and thus the frequency of repairing the grinding surface or the polishing surface can be reduced.

In this embodiment, since, the abrasive grain part 5 is formed on the base body 2, such a whetstone pellet 1 can be obtained that has a certain height without a prolonged period of time for forming the plated layer. Therefore, the whetstone pellet 1 has a size of good handling to improve the handling property upon fixing the whetstone pellet 1 on the pedestal 9.

In order to produce a whetstone 10 by using the whetstone pellets 1 as described above, a pedestal 9 having an inverse shape of a surface to be processed is prepared, on which the plural whetstone pellets 1 are fixed by using an adhesive or the like. Thereafter, the plane shape formed by continuation of the end surfaces of the plural whetstone pellets is finished to become an inverse shape of a goods' surface to be processed by grinding with a lapping disk or the like or by subjecting to machining.

EXAMPLE 1

A specific production process of the whetstone pellet 1 shown in FIG. 1 will be described with reference to FIG. 2.

A base body 2 is made of a stainless steel (SUS 304) material and formed into a columnar shape having a diameter of 14.4 mm and a height of 3 mm. Among two end surfaces of the base body 2, an end surface 3, on which an abrasive grain layer 5 is to be formed, is smoothed to Ra of 0.2 by machining.

Figure 2A:
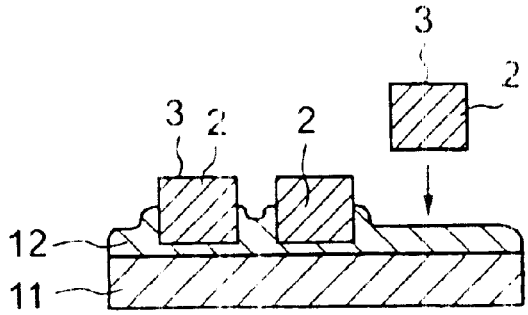
FIGS. 2A, 2B, 2C and 2D are explanatory views showing production procedures of a whetstone pellet in Example 1 of the present invention.

After degreasing the base body 2 and a fixing plate 11 with a solvent, a masking agent is coated on the fixing plate 11, and the end surface 3 of the base body 2 is placed thereon, so as to apply a masking film 12 to region on the surface of the base body 2 where no plating is to be applied, as shown in FIG. 2A. At this time, the arrangement of the base bodies is arbitrary provided that attention is paid to prevent the base bodies 2 and 2 from contacting to each other. As the masking agent, a commercially available plating masking agent, Turcos 5980-1A (a trade name, produced by Atofina Chemicals, Inc., U.S.), is used to function as both the adhesive used for fixing of the base bodies 2 and the masking agent used for masking the base bodies 2. The fixing plate 11 along with the plural base bodies 2, 2, . . . placed thereon are put in an oven of a temperature increased to 100° C., followed by baking for 1 hour, to cure the masking film 12.

Figure 2B:
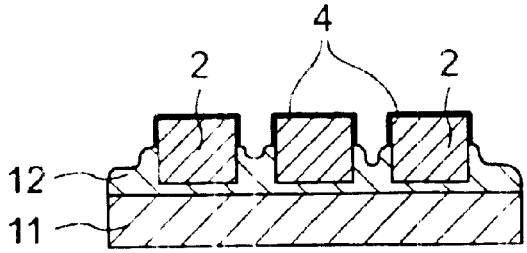

After curing the masking film 12, the base bodies 2, 2, . . . placed on the fixing plate 11 are sequentially subjected to alkali degreasing and activation with an acid and then immersed in an aqueous solution containing hydrochloric acid and palladium chloride as major components for 60 seconds, so as to form a palladium layer on the surface of the base body 2 where no masking film 12 is applied, as shown in FIG. 2B. The palladium layer thus formed becomes a catalyst layer 4 accelerating electroless plating. In the case where a metal capable of being a catalyst layer 4, such as iron, is used as material of the base body, there is no necessity of separate formation of a catalyst layer, but the surface, on which the catalyst layer is to be formed, is subjected to activation with an acid to make the surface as the catalyst layer.

Figure 2C:
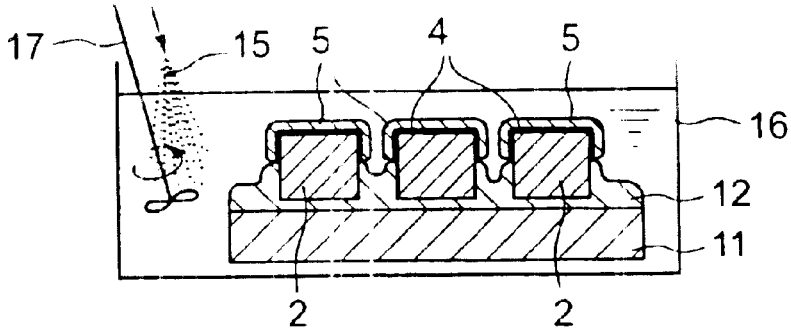

After forming the catalyst layer 4, the base bodies 2 placed on the fixing plate 11 are washed with water, and then they are put in an electroless nickel-phosphorous plating solution 16 containing abrasive grains 15, as shown in FIG. 2C. The electroless nickel-phosphorous plating solution 16, which is containing 0.2 weight percents of the diamond powder having a particle diameter of from 2 to 4 $\mu$m, is stirred with a stirrer 17. The content of the abrasive grains 15 in the plated layer can be adjusted by changing the put amount of the diamond powder and the stirring conditions, such as the rotation rate of the stirrer 17. The temperature of the plating solution 16 is 90° C., in which the base bodies 2 are put for 16 hours to deposit an electroless plated layer having a thickness of 0.3 mm. The electroless plated layer becomes an abrasive grain part 5 formed with an amorphous plated layer.

Figure 2D:
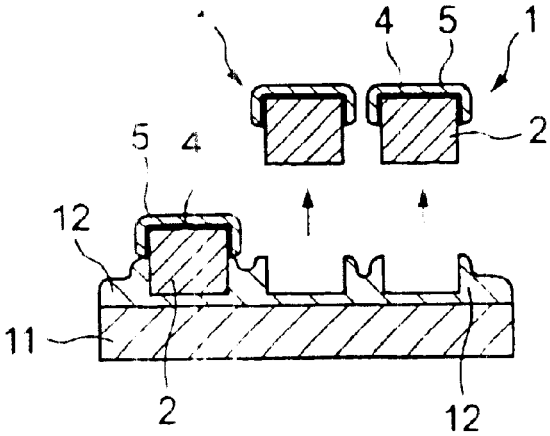

Upon depositing the electroless plated layer to a prescribed thickness, the fixing plate 11 is taken out from the plating bath, and the fixing plate 11 and the base bodies 2 are washed with water, followed by drying. The base bodies 2 are detached from the fixing plate 11, and the masking film 12 is removed, as shown in FIG. 2D, whereby whetstone pellets 1 having a diameter of the abrasive grain part 5 of 15 mm and a total height of 3.3 mm are completed. Upon detaching the whetstone pellets 1 from the fixing plate 11, the base bodies 2 and the fixing plate 11 after plating are immersed in a diluent solvent for the masking film 12 as they are, whereby the masking film 12 is dissolved, and the whetstone pellets 1 can easily be detached from the fixing plate 11, Second Embodiment A second embodiment according to the invention will be described.

The outline constitution of a whetstone of this embodiment is the same as the whetstone 10 described with reference to FIG. 1. That is, plural base bodies 2 are fixed on a pedestal 9, and an abrasive grain part 5 is formed on one end surface 3 of the base body 2. However, although the whetstone pellets 1 having been completed are fixed on the pedestal 9 to produce the whetstone 10 in the first embodiment, a whetstone 10 is to be produced through no process step of completing the whetstone pellets 1 in this embodiment.

Upon producing the whetstone 10, a pedestal 9 having an inverse shape of an objective surface to be processed is firstly produced. The material of the pedestal 9 is most suitably a metal since good adhesion adhesiveness to an adhesive described later is obtained, and a mechanical rigidity can be maintained. Suitable examples of the metal include aluminum, which can be easily worked by a casting method or cutting and is lightweight, and iron, which can be worked by a casting method.

Among the surface of the pedestal 9, the surface on which the abrasive grain parts are to be formed, may be roughly finished to improve adhesiveness to the adhesive, and may be subjected to a roughening treatment, such as a blasting treatment, depending on necessity. The surface of the pedestal 9, on which the abrasive grain parts are to be formed, may not be subjected to smooth finish as just described, and therefore, the processing cost of the pedestal 9 can be suppressed.

The material for making the base body 2 is the same as in the first embodiment, and the description thereof is omitted herein.

The shape of the base body 2 may be various shapes, such as a prismatic columnar shape, and a round columnar shape, and it may be formed into any shape depending on necessity. In the case where a round columnar product is to be obtained as similar to a resin-bonded pellet or a metal-bonded pellet, they can be easily obtained with suppressed processing cost by cutting a round bar at a constant interval. The end surface, which is to be fixed to the pedestal 9, of the both end surfaces of the base body 2 may be roughly finished to improve adhesiveness to the adhesive as similar to the pedestal 9, and another end surface, on which the abrasive grain part 5 is to be formed, may also be roughly finished since it is separately finished in the later process step. The end surface, which is to be fixed to the pedestal 9, maybe subjected to a roughening treatment, such as a blasting treatment, as similar to the pedestal 9.

The pedestal 9 and the plural base bodies 2 are thus obtained. After degreasing them, an adhesive is coated over the entire surface, on which abrasive grain parts are to be formed, of the pedestal 9, and a necessary number of the base bodies 2 are placed thereon. Because the surface of the pedestal 9 is a curved surface but is not a flat surface, the adhesive used herein is preferably one capable of preventing the base bodies 2 from moving along the curved surface by gravitation, and an epoxy adhesive having high viscosity is preferred.

It is possible upon fixing the base bodies 2 on the pedestal 9 that a protrusion or a depression is formed on the end surface of the base body 2, and a depression or a protrusion is formed on the pedestal at a position where the base body 2 is to be fixed, followed by engaging the protrusion or the depression of the base body 2 with the depression or the protrusion of the pedestal 9. In this case, an adhesive having low viscosity may be used since the base bodies 2 are not misaligned with respect to the pedestal 9.

After placing the base bodies 2 on the pedestal 9, a weight or the like is placed on the base bodies 2 for preventing the base bodies 2 from lifting from the pedestal 9 by the adhesive. Specifically, in the case where the surface of the pedestal 9 is a flat surface, it is preferred that the plural base bodies 2 are placed on a machine platen having a flat surface, and the pedestal 9 having an adhesive coated is placed thereon, so that the pedestal 9 itself is used as the weight. In the case where the pedestal 9 has a curved surface, it is preferred that the plural base bodies 2 are placed on the pedestal 9 having an adhesive applied, and then a lapping disk described later is placed thereon as the weight.

After the plural base bodies 2 are placed on the pedestal 9 having an adhesive applied, and the weight is placed thereon, the assembly is allowed to stand until the adhesive cures. In the case where the adhesive is of a thermosetting type, it is preferred that the assembly is placed in an oven or the like to reduce the curing time.

After curing the adhesive, the end surfaces of the base bodies 2 are subjected to a grinding process or a cutting process, whereby a plane shape formed by continuation of the end surfaces of the plural base bodies 2 has an inverse shape of an objective surface to be processed. A lapping disk having the same surface shape as the finished surface shape of the material to be processed is preferably used in the grinding process.

The pedestal 9 having the base bodies attached is then masked against electroless plating. To the surface of the pedestal 9, on which the abrasive grain parts are to be formed, the adhesive is applied, which functions as a masking agent, and therefore no masking is applied to the surface, but the back surface thereof is masked.

After drying the masking agent to form a masking film 12, a catalyst layer 4 for electroless plating is formed on a region on the surface of the base bodies 2, on which no masking film 12 is formed, as similar to the first embodiment.

After forming the catalyst layer 4, the pedestal 9 having the base bodies attached is put in an electroless plating solution containing abrasive grains mixed therein, so as to form an electroless plated layer containing abrasive grains, i.e., abrasive grain parts 5, on the catalyst layer of the respective base bodies 2. The electroless plating is carried out in the same manner as in the first embodiment.

After the thickness of the abrasive grain parts 5 has reached the objective thickness, the pedestal 9 having the base bodies attached is taken out from the electroless plating solution and is washed with water, and then the masking film 12 on the back surface of the pedestal 9 is removed to complete the whetstone 10.

In this embodiment as described above, the abrasive grain part 5, which is an electroless plated layer containing abrasive grains, is formed on the base body 2, and thus the similar effects as in the whetstone pellet 1 in the first embodiment can basically be obtained.

In this embodiment, furthermore, because the end surfaces of the base bodies 2 are finished by machining before forming the abrasive grain part 5 on the base bodies 2, so as to have the shape formed by continuation of the end surfaces of all the plural base bodies 2 fixed on the pedestal 9 has an inverse shape of an objective surface to be processed, the machining can be easily carried out within a short period of time in comparison to the case of the first embodiment, in which the completed whetstone pellets 1 are fixed on the pedestal 9, and then the abrasive grain parts 5 of the whetstone pellets 1 are finished by machining. This is because the target of the machining is not the considerably hard plated layer containing abrasive grains as in the first embodiment.

It is possible for forming a whetstone that plural grooves are formed on a pedestal, and protruded regions are used as parts for base bodies. In the case where grooves are formed on the pedestal, however, the regions of the grooves are also subjected to plating, and thus the consumption amounts of the plating solution, the abrasive grains and the like are considerably increased to push up the costs of the raw materials. In the case where the grooves are to be subjected to masking as a countermeasure, it requires a complex masking treatment, in which the grooves are masked while the surfaces of the protruded regions are prevented from masking. In this embodiment, on the other hand, the adhesive applied on the entire surface of the pedestal, on which the abrasive grain parts are to be formed, functions as a masking agent, whereby the consumption amounts of the plating solution, the abrasive grains and the like can be suppressed, and there is no necessity of separately masking on the surface of the pedestal, on which the abrasive grain parts are to be formed.

EXAMPLE 2

A specific production process of the whetstone 10 described in the second embodiment will be described with reference to FIG. 3. The whetstone 10 that is to be finally obtained in Example 2 is a whetstone of a spherical surface having a curvature radius of 197 mm.

The pedestal 9 is a part of an aluminum cast material, molded into a disk form having a diameter of 300 mm, and the surface thereof, on which the abrasive grain parts are to be formed, is formed into a spherical surface having a curvature radius of 200 mm. The surface is not subjected to any particular roughening treatment. The base bodies 2 are made of aluminum (A5056) and have a round columnar shape having a diameter of 10 mm and a height of 3 mm. The surface of the base body 2 is subjected to a shot treatment with glass beads of a grain size of #100.

Figure 3A:
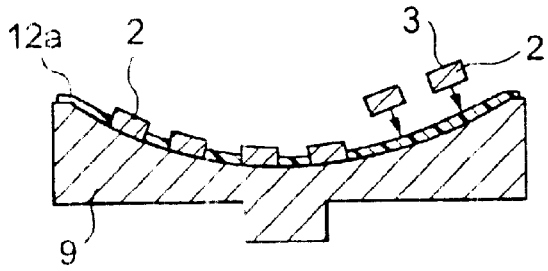
FIGS. 3A, 3B, 3C and 3D are is an explanatory views showing production procedures of a whetstone in Example 2 of the present invention.

After degreasing the pedestal 9 and the base bodies 2 with a solvent, an epoxy adhesive 12*a* is coated on the entire spherical surface of the pedestal 9, on which the abrasive grain parts are to be formed, as shown in FIG. 3A. As the adhesive, SC507A/B (a trade name, produced by Sony Chemicals Corp.) having relatively high viscosity is suitably used. The coated amount of the adhesive 12*a* is preferably such a thickness that is about half of the height of the base bodies 2. Subsequently, after placing the plural base bodies 2 on the adhesive 12*a*, a lapping disk 19 described later is placed thereon, and the adhesive 12*a* is cured. By placing the lapping disk 19 on the base bodies 2 as a weight in this manner, the base bodies 2 can be prevented from misalignment during the curing process of the adhesive 12*a*.

Figure 3B:
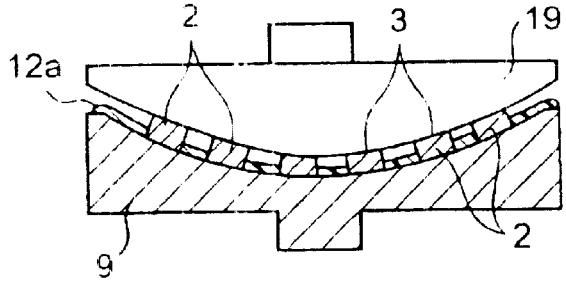

After curing the adhesive 12*a*, the end surfaces 3 of the base bodies 2 are ground by using the lapping disk 19 as shown in FIG. 3B, whereby the plane shape formed by continuation of the end surfaces 3 of the base bodies 2 is finished to be an inverse shape of a surface to be processed, i.e., the spherical surface. The lapping is carried out under supplying a mixture of silicon carbide grinding sand of a grain size of #600 and water to the lapping surface. The curvature radius of the spherical surface, which is to be obtained in this stage, is 197.3 mm under consideration of the thickness of the plated layer (0.3 mm).

Figure 3C:
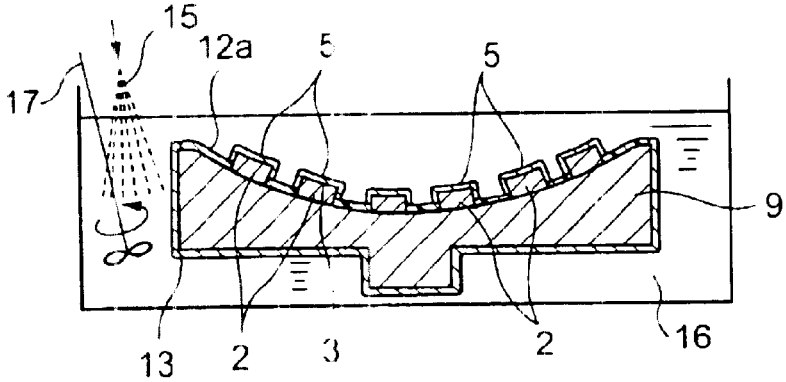
Figure 3D:
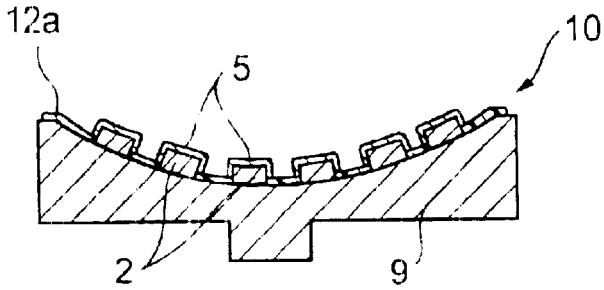

A masking film 13 is then formed on the surface of the pedestal 9 other than the spherical surface, i.e., on the back surface of the pedestal 9, by using a masking tape or a coating type masking agent (as shown in FIG. 3C). The pedestal 9 having the base bodies attached is sequentially subjected to alkali degreasing and activation with an acid, and then immersed in a zincate conversion solution for 30 seconds to form an zinc layer (not shown in the figure) on the side peripheral surfaces of the plural base bodies 2 and the end surfaces of the base bodies 2. The zinc layer functions as a catalyst layer for accelerating reaction of electroless plating.

After forming the catalyst layer, the pedestal 9 having the base bodies attached is washed with water and then put in an electroless nickel-phosphorous plating solution 16 containing abrasive grains 15 as shown in FIG. 3C, so as to deposit an electroless plated layer having a thickness of 0.3 mm on the end surfaces 3 of the base bodies 2. This is an amorphous plated layer, which is an abrasive grain part 5 thus formed. The conditions on the electroless plating process are the same as in Example 1.

After conducting the electroless plating, the pedestal 9 having the abrasive grain layer 5 formed thereon is taken out from the plating bath and washed with water, followed by drying, and then the masking film 13 attached to the back surface of the pedestal 9 is removed, so as to complete a whetstone 10 of a spherical surface having a curvature radius of 197 mm.

Figure 4A:
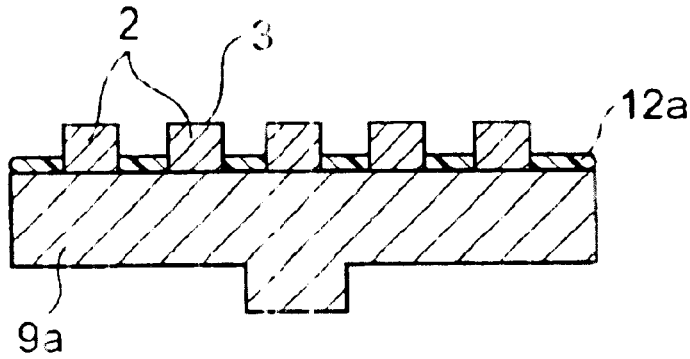
FIGS. 4A, 4B and 4C are explanatory views showing production procedures of a whetstone in a modified version of Example 2 of the present invention.

While the pedestal 9 having a spherical surface is used in Example 2 in conformity with the plane shape of the surface to be processed, the pedestal may not be always conformed to the plane shape of the surface to be processed, but for example, a pedestal 9*a* having a flat disk shape as shown in FIG. 4A may also be used. A production process of a whetstone by using the pedestal 9*a* will be briefly described below.

After applying the adhesive 12*a* on the entire surface of the pedestal 9*a* in the same manner as in Example 2, plural base bodies 2 having the same height are placed on the adhesive 12*a*, and the adhesive 12*a* is cured. In this case, the plural base bodies 2 are placed on a machine platen having a flat surface, and the pedestal 9*a* having the adhesive applied may be placed thereon, so that the pedestal 9*a* itself is used as the weight.

Figure 4B:
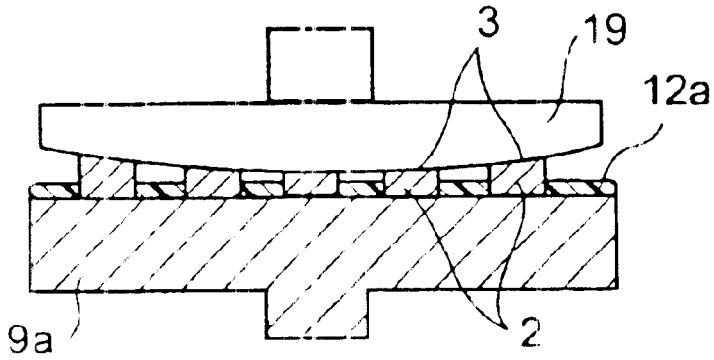
Figure 4C:
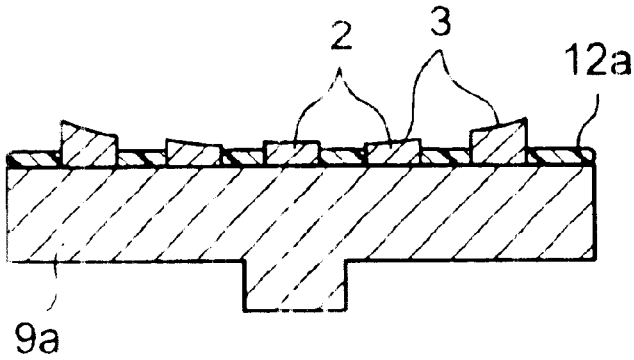

After curing the adhesive 12*a*, the end surfaces 3 of the base bodies 2 are ground by using a lapping disk 19 as shown in FIG. 4B, whereby the plane shape formed by continuation of the end surfaces 3 of the plural base bodies 2 is finished to be an inverse shape of a surface to be processed as shown in FIG. 4C. Subsequently, the plating process and the like are carried out in the similar manner as in Example 2 to complete the whetstone.

While the plural base bodies 2 having the same height are used above, it is possible that the base bodies, the height of which is to be reduced, i.e., the base bodies attached to the vicinity of the center of the pedestal 9*a* in this example, may be those having a smaller height than the other base bodies, so as to decrease the ground amount with the lapping disk 19.

PERFORMANCE TEST EXAMPLE 1

Results of the performance test upon grinding quartz glass by using the whetstone 10 produced in the manner described in the second embodiment will be described.

In the performance test, quartz glass of high hardness is processed by using various kinds of whetstones, and the grinding rate, the grinding accuracy and the like are obtained in the process. The subjects for the test are the whetstone 10 of the second embodiment, a conventional metal-bonded whetstone and a conventional resin-bonded whetstone.

The procedures shown in FIG. 5 are generally carried out in the case where an optical element is produced from a raw material of an optical element, which is a material to be processed. Specifically, in order to bring the shape of the raw material of an optical element 25*a* proximate to the shape of the desired optical element 25, the raw material 25*a* is subjected to shape creation as shown in FIGS. 5A and 5B. As shown in FIG. 5C, the surface of the raw material 25*b* having been subjected to shape creation is then roughly ground by using a whetstone 26*c* for rough grinding. Subsequently, as shown in FIG. 5D, the roughly ground surface of the raw material 25*c* is finely ground by using a whetstone 26*d* for fine grinding. Finally, as shown in FIG. 5E, the surface of the raw material 25*d* finely ground is polished to obtain an optical element 25 having a desired plane shape of the processed surface. In FIG. 5, the surface roughness is drawn with exaggeration for clarifying the change of the surface roughness of the raw material. Furthermore, while FIG. 5 is drawn such that only one surface of the raw material 25*a* is processed, it is needless to say that the other surface is also subjected to the similar processing in the case where the optical element is a lens. Moreover, while the optical element as a final product is obtained through the polishing process herein, the polishing process is not necessarily carried out after the fine grinding process in the case where the product falls within its specification even when the surface roughness is certainly large. Therefore, the product having been subjected to the fine grinding process is an intermediate product in some cases or a final product in other cases.

The test conditions for the performance test are as follows.

Whetstone of the second embodiment of the invention

| | |
|---|---|
| Diameter of bass body: | 10 mm |
| Material of abrasive grains: | diamond |
| Particle diameter of abrasive grains: (corresponding to mesh size #3500) | 2 to 4 μm |
| Thickness to abrasive grain layer: | 0.3 mm |

Conventional metal-bonded whetstone (for rough grinding)

| | |
|---|---|
| Diameter of pellets: | 10 mm |
| Material of abrasive grains: | diamond |
| Particle diameter of abrasive grains: | mesh size of #1500 |

Conventional resin-bonded whetstone (for fine grinding)

| | |
|---|---|
| Diameter of pellets: | 10 mm |
| Material of abrasive grains: | diamond |
| Particle diameter of abrasive grains: | mesh size of #3000 |

Raw material of optical element: quartz ($SiO_2$) glass

Shape of optical element: spherical convex lens having an outer diameter of 238 mm and a curvature radius R of 220 mm Grinding machine: elliptic movement type, produced by Tateno Co., Ltd.

Grinding fluid: water soluble concentrated grinding fluid diluted with water (concentrated grinding fluid/water= 1/15)

The whetstone of the second embodiment used in the test is composed of a pedestal having base bodies fixed with an interval of 5 mm. In the whetstones used herein, the distances of the base bodies are retained to a certain extent to suppress the area of the total grinding surface to 30% or less of the area of the surface of the pedestal, on which the abrasive grain parts are formed, whereby the discharge of the grinding dusts is facilitated.

The average grinding rate, the surface roughness of the raw material and the time required polishing in the polishing process carried out after the grinding process upon grinding the raw material of an optical element with the respective whetstones under the foregoing conditions, and the time required for figuring the whetstone, were those as shown in Table 1 below.

TABLE 1

| | Whetstone of embodiment of the invention | Metal-bonded whetstone | Resin-bonded whetstone |
|---|---|---|---|
| Average grinding rate | 28 μm/min | 28 μm/min | 5 μm/min |
| Surface roughness (Ry) | 0.47 μm | 2.85 μm | 0.48 μm |
| Time required for polishing | 90 min | could not be polished | 90 min |
| Time required for figuring whetstone | 35 min (10 min + 25 min) | 120 min | 120 min |

It is understood from Table 1 that the average grinding rate of the whetstone of the second embodiment is 28 μm/min, which is equivalent to the metal-bonded whetstone as a conventional whetstone for rough grinding and is considerably superior to the resin-bonded whetstone as a conventional whetstone for fine grinding. As described herein, the whetstone of the second embodiment contains abrasive grains having a particle diameter that is far smaller than the conventional whetstone for rough grinding, but exhibits an average grinding rate equivalent to the conventional whetstone for rough grinding. It is considered that this is because of the high retentivity of abrasive grains owing to the use of the plated layer as a binder material for the abrasive grain layer. The surface roughness after grinding is 0.47 μm for the whetstone of the second embodiment, which is equivalent to the resin-bonded whetstone as a conventional whetstone for fine grinding, and thus, it is far superior to the metal-bonded whetstone as a conventional whetstone for rough grinding. As described herein, because the surface roughness after grinding of the whetstone of the second embodiment is equivalent to that of the resin-bonded whetstone as a conventional whetstone for fine grinding, the time required for polishing in the polishing process carried out after grinding of the whetstone of the second embodiment is also equivalent to that of the resin-bonded whetstone as a conventional whetstone for fine grinding.

That is, the whetstone of the second embodiment is equivalent in average grinding rate to the metal-bonded whetstone as a conventional whetstone for rough grinding, and is equivalent in surface roughness and time required for polishing to the resin-bonded whetstone as a conventional whetstone for fine grounding. Accordingly, although different whetstones are used in a rough grinding process and a fine grinding process, respectively, in the conventional technique, basically the same results as in the conventional technique, i.e., surface roughness and time required for polishing equivalent to the conventional technique, can be obtained with the whetstone of the second embodiment without changing the whetstone in the rough grinding process and the fine grinding process.

Figure 5A:
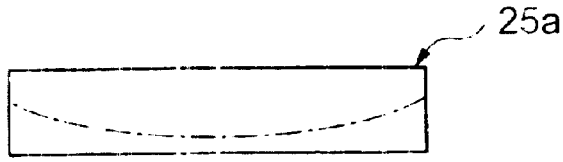
FIGS. 5A, 5B, 5C, 5D and 5E are explanatory views showing a process for producing an optical element.
Figure 5B:
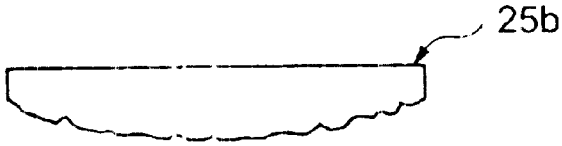
Figure 5C:
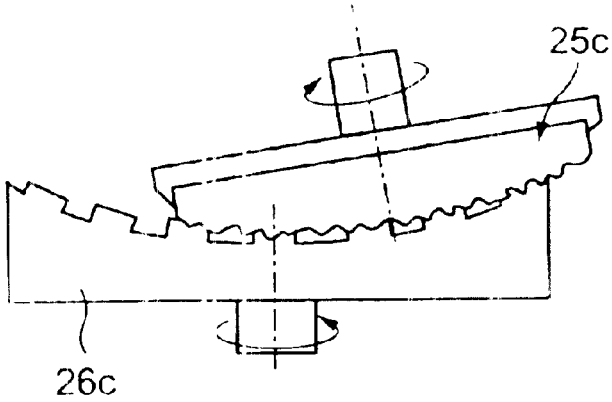
Figure 5D:
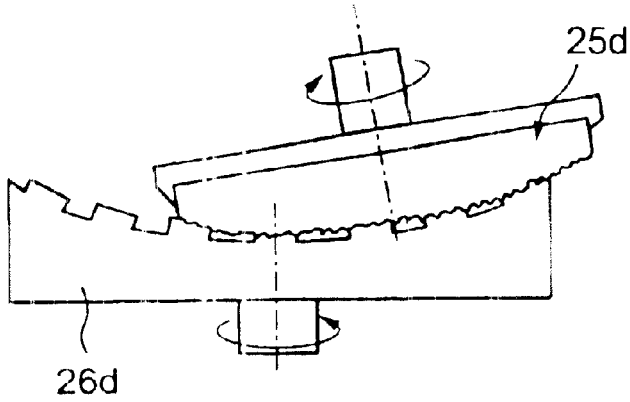
Figure 5E:
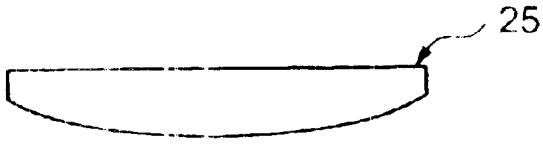

Therefore, in the case where grinding is carried out in such a manner that the grinding amount after the shape creation as shown in FIG. 5B is 150 μm, and the surface roughness after the grinding is 0.47 μm, the conventional technique requires about 5 minutes for the rough grinding process (≈150 μm (grinding amount)/28 μm per minute), about 5 minutes for the fine grinding process, and several minutes for an operation time to change the whetstones, so as to require 10 minutes or more as the total time required for grinding process. With respect to the whetstone of the second embodiment, on the other hand, the operation time to change the whetstones is omitted since no change of whetstones is required between the rough grinding process and the fine grinding process, and the total time required for the grinding process including the rough grinding process and the fine grinding process can be suppressed to about 5 minutes (≈150 μm (grinding amount)/28 μm per minute) The reason why the fine grinding process in the conventional technique requires about 5 minutes is that a crack layer (a part of the material that is deteriorated by processing strain) on the surface of the material formed by the rough grinding to an objective amount of about 150 μm, is necessarily removed by the fine grinding. On the other hand, by using the whetstone of the second embodiment, such a crack layer formed in the rough grinding of the conventional technique does not occur because the particle diameter of the abrasive grains contained therein is equivalent to or less than the particle diameter of the abrasive grains contained in the conventional whetstone for fine grinding.

TABLE 2

| | Whetstone of Embodiment of the invention | Conventional whetstone |
|---|---|---|
| Rough grinding time (min) | 5 | 5 |
| Fine grinding time (min) | | 5 |
| Time for changing whetstone (min) | 0 | α |
| Total grinding time (min) | 5 | 10 + α |

The time required for figuring the whetstone, i.e., the time required for modifying the grinding surface of the whetstone to an inverse shape of the surface to be processed (optical surface), is 35 minutes for the whetstone of the second embodiment and 120 minutes for both the conventional metal-bonded whetstone and resin-bonded whetstone. The reason why the time required for figuring the whetstone of the second embodiment is shorter is that in the second embodiment, the end surfaces of the relatively soft base bodies 2 are finished by machining before forming the abrasive grain part 5 on the base bodies, so that the plane shape formed by continuation of the end surfaces of all the base bodies 2 fixed on the pedestal 9 becomes an inverse shape of the desired surface to be processed. The time required for figuring the whetstone of the second embodiment includes 10 minutes as a time for processing the end surfaces of the base bodies 2 before forming the abrasive grain parts 5, and after forming the abrasive grain parts 5, 25 minutes as a time for finishing the abrasive grain parts 5, so as to take 35 minutes in total.

PERFORMANCE TEST EXAMPLE 2

Results of the performance test upon grinding fluorite by using the whetstone 10 produced in the manner described in the second embodiment will be described.

In the performance test, fluorite ($CaF_2$) having a crystalline structure is processed by using either the whetstone of the second embodiment or a resin-bonded whetstone which is a conventional whetstone for fine grinding, and the grinding rate, the grinding accuracy and the like are obtained in the process. Fluorite as a raw material of an optical element has dependency of processing characteristics on the crystallographic azimuth, and it has been known that a good plane as a surface to be processed (optical surface) is difficult to be evenly obtained. In this test, accordingly, such fluorite is used as a grinding object that is subjected to shape creation in such a manner that the 111 plane, the 110 plane or the 100 plane thereof is perpendicular to the optical axis.

The test conditions for the performance test are as follows.

Whetstone of the second embodiment of the invention

| | |
|---|---|
| Diameter of base body: | 6 mm |
| Material of abrasive grains: | diamond |
| Particle diameter of abrasive grains: (corresponding to mesh size #4000) | 1 to 3 μm |
| Thickness of abrasive grain layer: | 0.3 mm |

Conventional resin-bonded whetstone (for fine grinding)

| | |
|---|---|
| Diameter of pellets: | 6 mm |
| Material of abrasive grains: | diamond |
| Particle diameter of abrasive grains: | mesh size of #2000 |

Raw material of optical element: fluorite ($CaF_2$)

Shape of optical element: spherical convex lens having an outer diameter of 39 mm and a curvature radius R of 50 mm Grinding machine: Oscar type, produced by Ichimura Seisakusho Co., Ltd.

Grinding fluid: water soluble concentrated grinding fluid diluted with water (concentrated grinding fluid/water= 1/15)

The whetstone of the second embodiment used in the test is composed of a pedestal having base bodies fixed with an interval of 3 mm. In the whetstones used herein, the distances of the base bodies are retained to a certain extent to suppress the area of the total grinding surface to 30% or less of the area of the surface of the pedestal, on which the abrasive grain parts are formed, whereby the discharge of the grinding dusts is facilitated.

The average grinding rate, the surface condition of the raw material, the surface roughness of the raw material and the time required for polishing in the polishing process carried out after the grinding process upon grinding the raw material of an optical element with the respective whetstones under the foregoing conditions, and the time required for figuring the whetstone, were those as shown in Table 3 below.

TABLE 3

| | Whetstone of embodiment of the invention | Resin-bonded whetstone (conventional whetstone) |
|---|---|---|
| Average grinding rate | 12 μm/min | 10 μm/min |
| Surface condition | gloss on whole surface | glossy parts and white turbid parts mixed |
| Surface roughness (Ry) | 0.13 μm | 0.19 μm for glossy parts<br>1.11 μm for white turbid parts |
| Time required for polishing | 120 min | ≧480 min |
| Time required for figuring whetstone | 15 min (5 min + 10 min) | 60 min |

It is understood from Table 3 that the whetstone of the second embodiment is somewhat superior to the conventional resin-bonded whetstone although the abrasive grains thereof are smaller than the abrasive grains of the conventional resin-bonded whetstone. It is considered that this is because of the higher retentivity of abrasive grains of the whetstone of the second embodiment as mentioned in Performance Test Example 1.

Figure 6A:
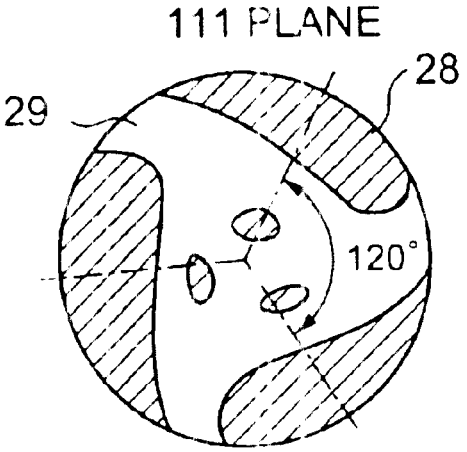
FIGS. 6A, 6B and 6C are explanatory views showing surface conditions upon grinding fluorite with a conventional resin-bonded whetstone.
Figure 6B:
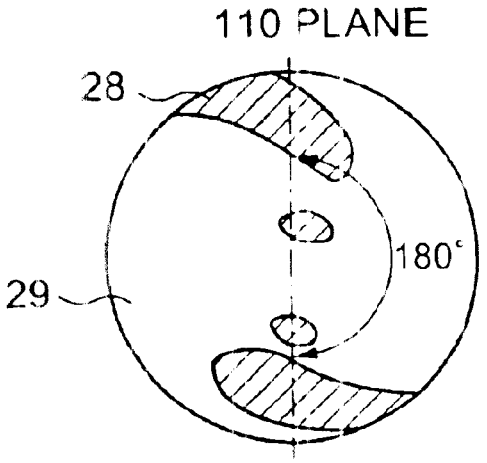
Figure 6C:
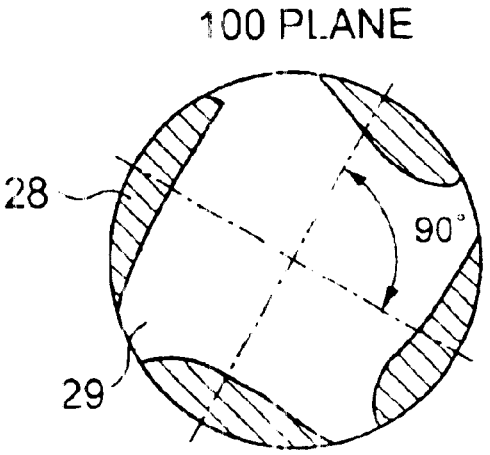

In the condition of the surface to be processed after grinding in the case using the conventional resin-bonded whetstone, the white turbid surface 28 and the glossy surface 29 are mixed in any crystallographic azimuth as shown in FIG. 6. More specifically, in the case where the fluorite is ground with the 111 plane thereof perpendicular to the optical axis of a lens made by this test as shown in FIG. 6A, white turbid surfaces 28 appear by 120° with respect to the optical axis as the center, in the case where the fluorite is ground with the 110 plane thereof perpendicular to the optical axis as shown in FIG. 6B, white turbid surfaces 28 appear by 180° with respect to the optical axis as the center, and in the case where the fluorite is ground with the 100 plane thereof perpendicular to the optical axis as shown in FIG. 6C, white turbid surfaces 28 appear by 90° with respect to the optical axis as the center. These are tendencies that appear on repeated grinding. The reason why the white turbid surface 28 is formed is that the crack layer described in the foregoing is formed in the white turbid surface layer part. In the case where the conventional resin-bonded whetstone is used, the surface roughness after grinding is 0.19 $\mu$m on the glossy surface and 1.11 $\mu$m for the white turbid surface.

On the other hand, the whetstone of the second embodiment provides a glossy surface on the entire surface to be processed, which is contrary to the common knowledge that a good plane as a surface to be processed is difficult to be evenly obtained, as described in the foregoing. Furthermore, the surface roughness after grinding is 0.13 $\mu$m, which is superior to the conventional resin-bonded whetstone. The reason why the whetstone of the second embodiment is superior to the conventional resin-bonded whetstone in surface condition and surface roughness after grinding as just described is not clear, but it is considered that this is because of the smaller abrasive grains and the uniform distribution of the abrasive grains in the whetstone of the second embodiment.

As described in the foregoing, the whetstone of the second embodiment is superior in surface condition and surface roughness after grinding, and thus the time required for polishing after the grinding process is 120 minutes, which is ¼ of the case using the conventional resin-bonded whetstone. The reason why the time required for polishing in the case using the conventional resin-bonded whetstone is significantly prolonged to 480 minutes or more is that the crack layer forming white turbidity on the processed surface is necessarily removed by polishing.

The time required for figuring the whetstone is 15 minutes for the whetstone of the second embodiment and 60 minutes for the conventional resin-bonded whetstone.

It is needless to say that the grinding performance of the whetstone of the second embodiment is basically equivalent to the grinding performance of the whetstone of the first embodiment. However, because the first embodiment is obtained by fixing the whetstone pellets 1 having the abrasive grain layer formed thereon on the pedestal 9, it is necessary that the hard abrasive grain layers are directly processed in the figuring operation of the whetstone, and the time required for figuring is longer than the second embodiment and provides no significant difference from the conventional technique.

Third Embodiment

A third embodiment according to the invention will be described.

The whetstone of this embodiment has an abrasive grain layer formed by electrolytic plating but not electroless plating, and other basic constitutions are the same as the second embodiment.

A pedestal and plural base bodies are firstly prepared as similar to the second embodiment. However, it is necessary that the pedestal and the base bodies are made of electroconductive materials, and as such materials, for example, iron, stainless steel, aluminum and the like are preferred.

After degreasing the pedestal and the base bodies with a solvent, the necessary number of base bodies are placed on the surface of the pedestal, on which the abrasive grain parts are to be formed, and then an epoxy adhesive is applied among the plural base bodies. In other words, the adhesive is not applied to the end surfaces of the base bodies, but the adhesive is applied to the side surfaces of the base bodies and a region among base bodies on the surface of the pedestal, whereby the base bodies are fixed on the pedestal while maintaining electroconductivity between the base bodies and the pedestal. The reason why the adhesive is not applied to the end surfaces of the base bodies is to ensure electroconductivity between the base bodies and the pedestal, and therefore, the adhesive may be applied to a part of the end surface of the base body. Furthermore, in order to ensure mechanical connectivity between the base bodies and the pedestal, a protrusion or a depression may be formed on the end surface of the base body, and a depression or a protrusion may be formed on the pedestal at a position where the base body is to be fixed, followed by engaging the protrusion or the depression of the base body with the depression or the protrusion of the pedestal.

After curing the adhesive, the end surfaces of the base bodies are ground or cut, whereby the plane shape formed by continuation of the end surfaces of the base bodies fixed on the pedestal becomes an inverse shape of the desired surface to be processed, as similar to the second embodiment.

After attaching a cathode for electrolytic plating to the back surface of the pedestal having the base bodies, the back surface of the pedestal is masked against electrolytic plating, and the regions that are not masked, i.e., the end surfaces of the base bodies and the like, are subjected to pretreatment for electrolytic plating.

After completing the pretreatment for plating, an anode is placed in an electrolytic plating solution, and abrasive grains are mixed therein. The abrasive grains in this case may be diamond powder, cubic boron nitride or the like, as similar to the first embodiment. The pedestal having the base bodies is immersed in the electrolytic plating solution having abrasive grains mixed therein, and an electric current is applied between the anode in the electrolytic plating solution and the cathode attached to the pedestal under stirring the electrolytic plating solution, so as to form electrolytic layers containing abrasive grains, i.e., abrasive grain parts, on the end surfaces of the base bodies.

After completing the formation of the abrasive grain parts, the pedestal is taken out from the electrolytic plating solution and washed with water, and then the masking agent on the back surface of the pedestal is removed. After removing the masking agent, the surfaces of the abrasive grain parts formed on the end surfaces of the plural base bodies are lapped with a lapping disk or the like to form a prescribed plane shape, to complete the whetstone. The lapping is necessarily carried out since the thickness of the plating layer cannot be uniform by formed due to the concentrated deposition of the electrolytic plated layer to convex parts and peripheral parts in electrolytic plating process, as described in the first embodiment.

As described in the foregoing, in this embodiment, because the abrasive grains are mixed in the plating solution which is a liquid form, the abrasive grains can be uniformly dispersed in the plated layer thus deposited. Furthermore, the plated layer formed by the electrolytic plating method is used as a binder material for the abrasive grains in the plated layer, and thus high retentivity of the abrasive grains can be obtained to prolong the service life of the whetstone. Since the plated layer as a binder material is basically hard, it suffers less surface denaturation of the abrasive grain layer upon grinding and polishing, and thus the frequency of repairing the grinding surface or the polishing surface can be reduced. Furthermore, since the adhesive is applied on the surface of the pedestal, on which the abrasive grain parts are to be formed, among the plural base bodies, the adhesive also functions as a masking agent, and the plated layer is prevented from forming among the plural base bodies although masking using another material is not separately carried out.

The grinding performance of the whetstone of this embodiment is basically equivalent to the grinding performance of the second embodiment. However, because the whetstone of this embodiment cannot have an abrasive grain layer having a uniform thickness as described in the foregoing, the time required for figuring is longer than the second embodiment and provides no significant difference from the conventional technique.

While the production process of a whetstone has been described, it is needless to say that a whetstone pellet having an electrolytic plating layer containing abrasive grains as an abrasive grain part can be produced by using a fixing plate instead of the pedestal, as in the first embodiment.

EXAMPLE 3

A specific production process of the whetstone described in the third embodiment will be described with reference to FIGS. 7 and 8.

A pedestal 9*b* is made of cast iron and has a disk form. A base body 2*b* is made of stainless steel (SUS304) and has a columnar form. The surfaces of the pedestal 9*b* and the base bodies 2*b* have been subjected to a shot treatment with glass beads of a grain size of #100.

Figure 7A:
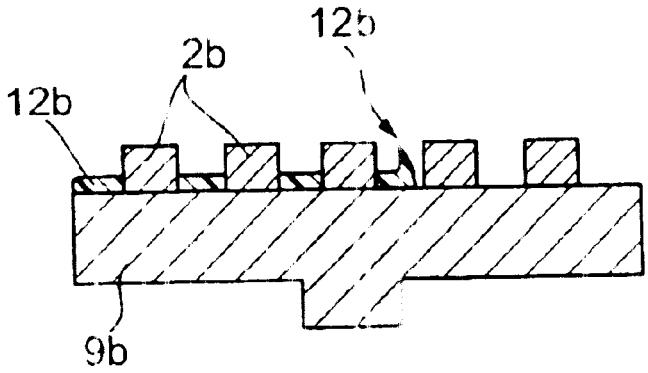
FIGS. 7A, 7B, 7C, 8D and 8E are explanatory views showing production procedures of a whetstone in Example 3 of the present invention.
Figure 7B:
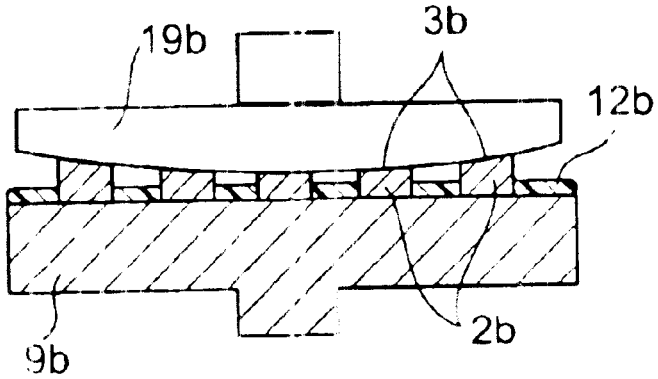

After degreasing the pedestal 9*b* and the base bodies 2*b* with a solvent, a necessary number of the base bodies 2*b* are placed on the pedestal 9*b*, and then an epoxy adhesive 12*b* is applied on the surface of the pedestal 9*b*, on which abrasive grain parts are to be formed, as shown in FIG. 7A. As the adhesive 12*b*, EP-138 (a trade name, Cemedine Co., Ltd.) and SC507A/B (a trade name, produced by Sony Chemicals Corp.) used in Example 2 are preferably used. The application amount of the adhesive 12*b* is preferably such a thickness that is about half of the height of the base bodies 2*b*. After applying the adhesive 12*b*, a weight is placed on the plural base bodies 2*b*, and the adhesive 12*b* is cured.

After curing the adhesive 12*b*, the end surfaces 3*b* of the base bodies 2*b* are ground by using the lapping disk 19*b* as shown in FIG. 73, whereby the plane shape formed by continuation of the end surfaces 3*b* of the base bodies 2*b* is finished to be an inverse shape of a surface to be processed. The lapping is carried out under supplying a mixture of silicon carbide grinding sand of a grain size of #600 and water to the lapping surface.

Figure 7C:
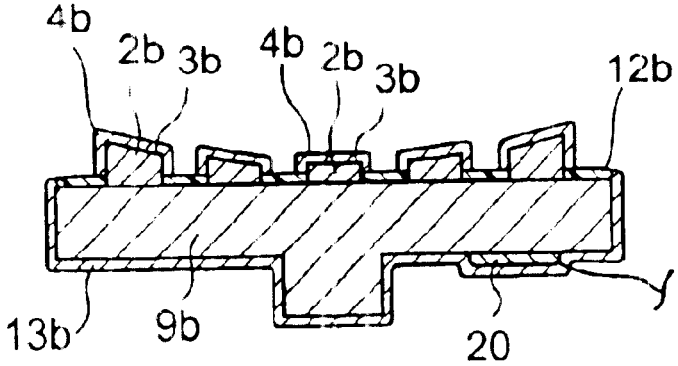

After subjecting the pedestal 9*b* having base bodies to alkali degreasing and activation with an acid, a cathode 20 for electrolytic plating is attached to the back surface of the pedestal 9*b*, and then a masking film 13*b* is formed on the back surface of the pedestal 9*b* by using a masking tape or a coating type masking agent, as shown in FIG. 7C. The pedestal 9*b* having the base bodies is sequentially subjected to nickel strike plating 4*b*. In the electrolytic plating process, an electric current of about 10 A per 100 $cm^2$ of the surface area is applied for about 2 minutes to form an extremely thin plated film on the end surface 3*b* of the base body 2*b*. The electrolytic plating process is carried out for electrochemical activation of the surface of stainless steel since the base bodies 2*b* is made of stainless steel.

Figure 8D:
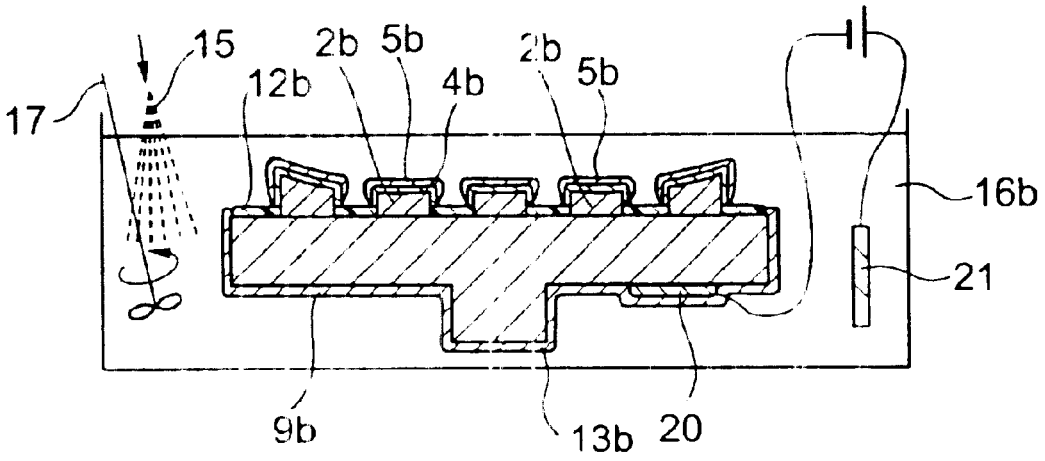

After completing the pretreatment for plating, an anode 21 is placed in an electrolytic plating solution 16*b*, and abrasive grains 15 are mixed therein, as shown in FIG. 8D. In Example 3, a nickel sulfamate plating solution having a pH of 4 at a temperature of 50° C. is used as the electrolytic plating solution 16*b*, and diamond powder having a particle diameter of from 2 to 4 $\mu$m is used as the abrasive grains 15. The pedestal 9*b* having the base bodies is immersed in the electrolytic plating solution 16*b* having the abrasive grains 15 mixed therein, an electric current is applied between the anode 21 in the electrolytic plating solution 16*b* and the cathode 20 attached to the pedestal 9*b* under stirring the electrolytic plating solution 16*b* with a stirrer 17, whereby electrolytic plating layers containing the abrasive grains 15, i.e., abrasive grain parts 5*b*, are formed on the end surfaces of the base bodies 2*b*. In the electrolytic plating process, an electric current of 5 A per 100 $cm^2$ of the surface area is applied for about 4 hours to form the abrasive grain parts 5*b* having a thickness of 0.24 mm.

Figure 8E:
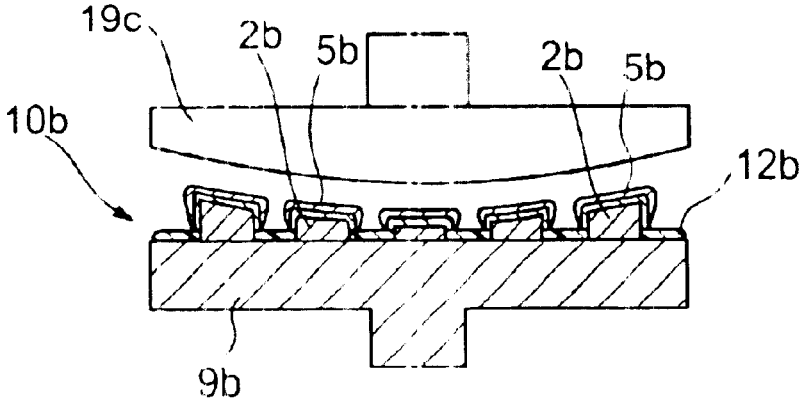

After completing the formation of the abrasive grain parts 5*b*, the pedestal 9*b* having the abrasive grain parts 5*b* thus formed is taken out from the electrolytic plating solution 1*b* and washed with water, and the masking film 13*b* on the back surface of the pedestal 9*b* is removed. Thereafter, lapping is carried out with a lapping disk 19*c* as shown in FIG. 8E, whereby the plane shape formed by continuation of the surfaces of the abrasive grain parts 5*b* formed on the end surfaces of the base bodies 2*b* fixed on the pedestal 9*b* is finished to be an inverse shape of a surface to be processed.

In the case where a fixing plate is used for forming the whetstone pellets instead of the pedestal, as described in the foregoing, turco 5980-1A (a trade name, produced by Atofina Chemicals, Inc., U.S.) used in Example 1 is preferably used as the adhesive for preliminary fixing the base bodies on the fixing plate.

Embodiment of Exposure Apparatus

Figure 9:
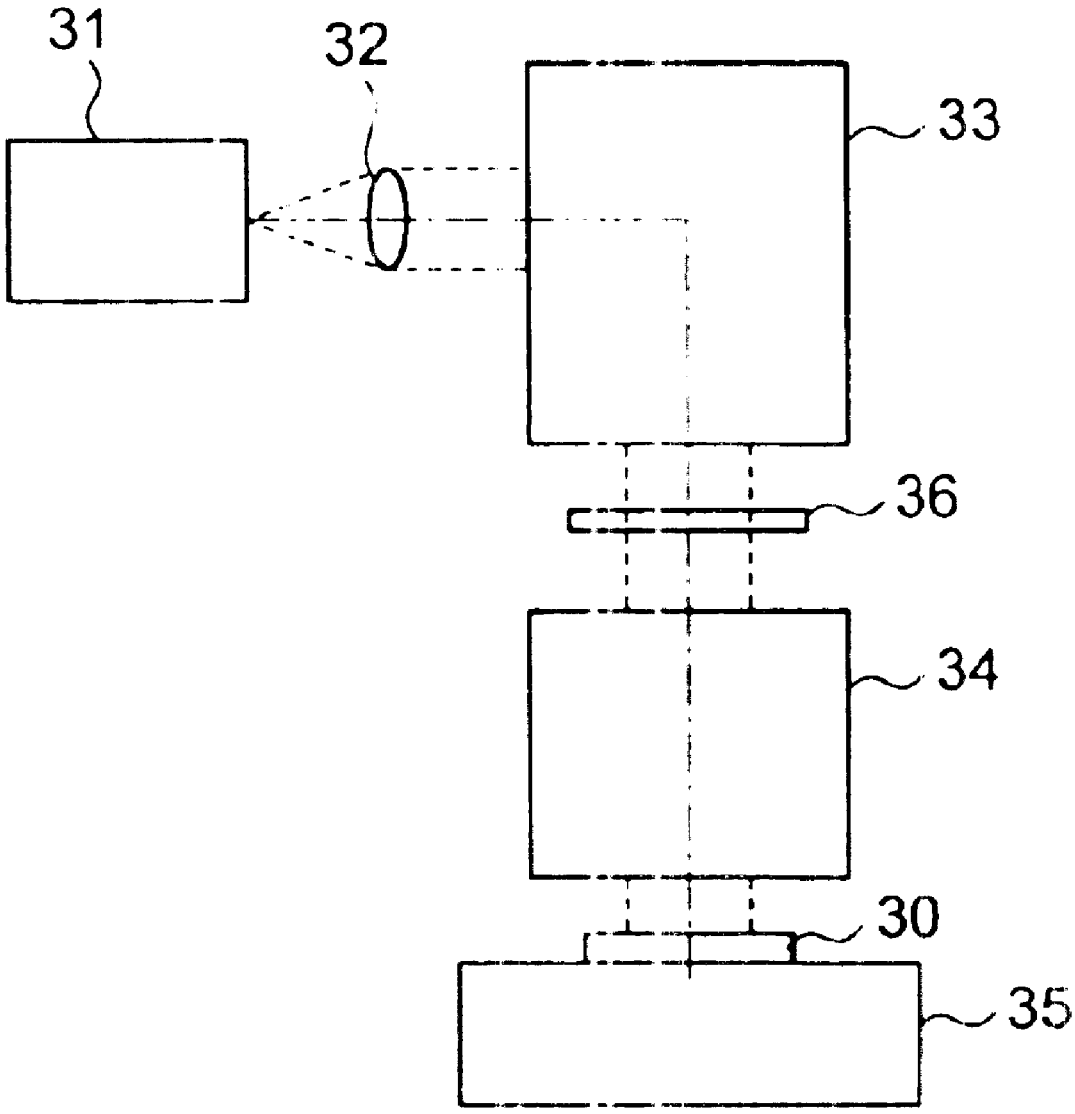
FIG. 9 is a constitutional view of an exposure apparatus of one embodiment of the present invention.

An embodiment of an exposure apparatus of the invention will be described with reference to FIG. 9.

The exposure apparatus in this embodiment is to project a pattern on a silicon wafer 30, and has a light source 31, a condenser lens 32, an illuminating optical system 33, a projecting optical system 34 and a stage 35, on which the silicon wafer 30 is placed. A reticle 36 having a pattern formed thereon corresponding to the processing contents of the silicon wafer 30 is appropriately arranged between the illuminating optical system 33 and the projecting optical system 34. As the light source 31, an ArF laser emitting light having an extremely short wavelength or an $F_2$ laser emitting light having a still further short wavelength is used in this embodiment. The illuminating optical system 33 has such a function that the distribution of light intensity over the light path is uniformized, and the projecting optical system 34 has such a function that an image on the reticle 36 is focused on the silicon wafer 30.

It is demanded for the latest exposure apparatus that the pattern on the reticle 36 is projected by using light having a shorter wavelength as described in the foregoing in order to project a minute pattern on the silicon wafer 30. Therefore, in order to deal with light having a short wavelength in this embodiment, all the condenser lens 32, various lenses in the illuminating optical system 33 and various lenses in the projecting optical system 34 are made of quartz or fluorite.

It has been found in the case where fluorite is ground that good results are obtained when the whetstones of the embodiments of the invention having been described are used, as described in Performance Test Example 2. In this embodiment, therefore, the various lenses constituting the optical exposure apparatus are obtained by grinding fluorite by using one of the whetstones of the embodiments of the invention as described above, preferably the whetstone of the second embodiment. The lenses thus obtained can be shape created in a short period of time with high accuracy for the exposure apparatus, and thus they contribute to reduction of the production cost of the aligner itself.

What is claimed is:

1. A process for producing a whetstone, comprising the steps of:

fixing plural base bodies on plural positions of a pedestal where at least one abrasive grain layer is formed, and forming the abrasive grain layer on at least one end surface of each base body.

2. A process for producing a whetstone according to claim 1, wherein said step of forming the abrasive grain layer comprises the step of immersing said pedestal into a plating solution containing abrasive grains.

3. A process for producing a whetstone according to claim 2, wherein said plating solution in said step of forming the abrasive grain layer is an electroless plating solution.

4. A process for producing a whetstone according to claim 3, further comprising the steps of:

processing said plural base bodies fixed on said pedestal, before proceeding to said step of forming the abrasive grain layer, so that a shape formed by continuation of end surfaces of plural base bodies fixed on said pedestal corresponds to the inverse shape of an object to be processed.

5. A process for producing a whetstone according to claim 4, further comprising a step of:

forming a catalyst layer to promote the precipitation of the plating layer from the plating solution onto at least one of each end surface of said base bodies.

6. A process for producing a whetstone according to claim 3, wherein said step of fixing plural base bodies on said pedestal, comprising at least the steps of:

masking a fixing surface of said pedestal with a masking agent, and fixing said plural base bodies on the fixing surface of said pedestal.

7. A process for producing a whetstone according to claim 6, wherein said masking agent is made of adhesive.

8. A process for producing a whetstone according to claim 6, further comprising the step of:

processing said plural base bodies fixed on said pedestal, after proceeding to said step of fixing plural base bodies on said pedestal, so that a shape formed by continuation of end surfaces of plural base bodies fixed on said pedestal corresponds to the inverse shape of an object to be processed.

9. A process for producing a whetstone according to claim 8, further comprising the step of:

forming a catalyst layer to promote the precipitation of the plating layer from the plating solution onto at least one of each end surface of said base bodies.

* * * * *